US009285124B2

(12) United States Patent
Chan

(10) Patent No.: US 9,285,124 B2
(45) **Date of Patent: *Mar. 15, 2016**

(54) COMBINED RADIATOR AND REMOTE CONTROL AND SWITCH APPARATUS AND LIGHTING ASSEMBLY

(75) Inventor: Paul Kam Ching Chan, Hong Kong (CN)

(73) Assignee: IPOWER TECHNOLOGY LIMITED, Hong Kong (CN)

( * ) Notice: Subject to any disclaimer, the term of this patent is extended or adjusted under 35 U.S.C. 154(b) by 1381 days.

This patent is subject to a terminal disclaimer.

(21) Appl. No.: 13/499,828

(22) PCT Filed: Sep. 29, 2009

(86) PCT No.: PCT/CN2009/001103

§ 371 (c)(1),
(2), (4) Date: Jul. 26, 2012

(87) PCT Pub. No.: WO2010/037273

PCT Pub. Date: Apr. 8, 2010

(65) Prior Publication Data

US 2012/0279950 A1 Nov. 8, 2012

Related U.S. Application Data

(60) Provisional application No. 61/102,483, filed on Oct. 3, 2009.

(51) Int. Cl.

| | |
|---|---|
| ***H05B 1/00*** | (2006.01) |
| ***F24C 7/06*** | (2006.01) |
| ***F24C 15/22*** | (2006.01) |

(52) U.S. Cl.

CPC ..... *F24C 7/065* (2013.01); *F24C 15/22* (2013.01)

(58) Field of Classification Search

CPC ..... F24C 7/065; F24C 7/04; F24C 15/22
USPC ..... 392/407–440; 219/405–411
See application file for complete search history.

(56) References Cited

U.S. PATENT DOCUMENTS

| | | | | |
|---|---|---|---|---|
| 7,805,065 | B2 * | 9/2010 | Chan | 392/420 |
| 8,172,416 | B2 * | 5/2012 | Chan | 362/92 |
| 2004/0152028 | A1 * | 8/2004 | Singh et al. | 431/328 |
| 2008/0205863 | A1 * | 8/2008 | Marino et al. | 392/377 |

FOREIGN PATENT DOCUMENTS

| | | | | |
|---|---|---|---|---|
| EP | 1 077 351 | A | 2/2001 | |
| EP | 1 770 338 | A1 | 4/2007 | |
| JP | 2007520864 | A * | 7/2007 | F24C 15/22 |
| WO | WO 2005/078356 | A1 | 8/2005 | |
| WO | WO 2007/090354 | A1 | 8/2007 | |

* cited by examiner

*Primary Examiner* — Phuong Nguyen
(74) *Attorney, Agent, or Firm* — Birch, Stewart, Kolasch & Birch, LLP

(57) ABSTRACT

At least two radiation members are each powered by an energy source. A reflective member includes an at least partially ring-shaped concave reflective surface facing at least one radiation member which includes an at least partial ring shape for distributing energy to an at least partially ring-shaped zone. At least one other radiation member includes a lamp base assembly for being received in a lamp socket assembly, to provide illumination or other forms of radiation, with concentration in a focal zone. A remote control and switch apparatus or radiation scanning and detection control and switch apparatus is provided, for control of remote power activation, the radiation members and for activating, varying, modifying and/or controlling, optimizing, maximizing, minimizing or otherwise altering the complete or partial constructive interference and/or the complete or partial destructive interference of the electromagnetic radiation emitted from the respective radiation sources of the radiator.

19 Claims, 7 Drawing Sheets

COMBINED RADIATOR AND REMOTE CONTROL AND SWITCH APPARATUS AND LIGHTING ASSEMBLY

CROSS REFERENCE TO RELATED APPLICATIONS

This application is the National Phase of PCT/CN2009/001103 filed on Sep. 29, 2009, which claims priority under 35 U.S.C. 119(e) to U.S. Provisional Application No. 61/102,483 filed on Oct. 3, 2008. The entire contents of the above application are hereby incorporated by reference.

BACKGROUND OF INVENTION

The Wien's Displacement Law states that the peak wavelength of emission of a black body is inversely proportional to its temperature as: $\lambda=b/T$. $\lambda$ is the peak wavelength in meters of the emission of the black body, b is the Wien's displacement constant with a value of approximately $2.8977865\times10^{-3}$ m K, and T is the temperature of the black body in degrees Kelvin.

Every object that has a temperature above absolute zero (that is, −273° C.) emits electromagnetic radiation. According to Planck's Equation, the radiation emitted by an object is a function of the temperature and emissivity of the object, and the wavelength of the radiation. Irradiation from an object increases with increasing temperature above absolute zero, and quantum energy of an individual photon is inversely proportional to the wavelength of the photon. The Total Power Law states that when radiation is incident on a body, the sum of the radiation absorbed, reflected and transmitted is equal to unity.

The Stefan-Boltzman Law states the total radiation emission for any body at a given temperature as: $R=ECT^4$. E is the emissivity of the body, which is the ratio of the total emission of radiation of such body at a given temperature to that of a perfect blackbody at the same temperature. For a blackbody, which is a theoretical thermal radiating object that is a perfect absorber of incident radiation and perfect emitter of maximum radiation at a given temperature, E=1; for a theoretical perfect reflector, E=0; and for all other bodies $0<E<1$. C is the Stefan-Boltzman constant with a value of approximately $5.67\times10^{-8}$ W/m$^2$ K$^4$. T is the absolute temperature of the body in degrees Kelvin.

Human beings with body temperature at approximately 37° C. or 310 K emit infrared radiation at peak wavelength of 9.3 μm, and the total surface area of a typical person is approximately 2 square meters, and the emissivity of human skin surface is approximately 0.98. The total emission from a typical person is approximately 1026 Watts based upon the Stefan-Boltzman Law calculated as follows:

$$\text{Total radiation emission}=(0.98)(5.67\times10^{-8}\ \text{W/m}^2\ \text{K}^4)(310\ \text{K})^4(2\ \text{m}^2)=1026\ \text{Watts}$$

The superposition of two electromagnetic waves of the same frequency will result in a new electromagnetic wave pattern. In appropriate circumstances, where two equally strong electromagnetic waves are in-phase in that when such waves have their fields in the same direction in space and time, the resulting electromagnetic field strength will be twice that of each individual wave, and the resulting wave intensity, being proportional to the square of the field strength, will be four times the intensity of each of the two superposing electromagnetic waves. This effect is often referred to as constructive interference. Conversely, the superposition of two similar electromagnetic waves, which are out-of-phase, will yield zero intensity. This effect is often referred to as destructive interference. Furthermore, similar or intermediate effects or results can be extended to or achieved through any number of complete or partial constructive interference and/or complete or partial interference of electromagnetic waves with different resultant electromagnetic wave patterns.

Lamps and lighting equipment and heat radiant apparatuses have been used as separate devices at home, church, or other places of commerce to provide a warm and illuminated atmospheric and environment and at times with decorative elegance, and mostly electrically wired and with manual on/off switches.

What is desired for is a combined radiator and lighting assembly that can provide heat radiation or illumination or both with the ease and convenience of remote control and switch apparatus, which saves energy and is environmentally friendly.

PCT Patent Publication No. WO 2005/078356 ("the '78356 Publication") and PCT Patent Publication No. WO 2007/090354 ("the '90356 Publication"), which we incorporate by reference, disclose different kinds of radiators.

The present invention relates to a combined radiator and remote control and switch apparatus and lighting assembly. In particular, the present invention relates to a novel combo type radiator and remote control and switch apparatus and lighting assembly for concentrating or dispersing energy and illumination coupled with the ease and convenience of remote control and switch apparatus, including, without limitation, infrared or other forms of radiation, radio frequency, microwave, ultrasonic, laser, mechanical, and motion detector control and switch apparatuses, so that the radiator will be activated and/or in operation only if human being(s), other mammal(s) or specified object(s) for whom/which the novel combo type radiator is designed to serve or entertain, are present in or close to its vicinity, and thereby saving a tremendous amount of energy and is environmentally friendly. The remote control and switch apparatus may include appropriate silicon controlled rectifier(s) or other rectifier(s), phase-controlling element(s), potentiometer(s) (including, without limitation, linear, logarithmic, digitally controlled and rheostat), voltage-controlled resistor(s), variable resistor(s), thyristor(s), thyratron(s), trimmer(s), rheostat(s), by-directional triode thyristor(s) or other electricity control device(s) (whether computer-aided, robotic or cybernetic) for variation or modification of the electric power and/or electric current of the respective radiation source(s) and the respective temperature whereof, and thereby activating, varying, modifying and/or controlling, optimizing, maximizing, minimizing or otherwise altering the complete or partial constructive interference and/or the complete or partial destructive interference of the electromagnetic radiation emitted from the respective radiation sources of the radiator. The radiation emitted from the radiation sources can be varied, modified and/or controlled for the purposes of heating or irradiating bodies, objects, substances or matter (including, but without limitation, food and other materials) placed or found within different irradiated zones, namely, inner irradiated zone 22 and outer irradiated zone 21, with a view to further saving, optimizing, maximizing or otherwise altering the efficient use of energy and radiation emitted from the radiation sources and whilst optimizing, maximizing, minimizing or otherwise altering the effect of radiation and activating, varying, modifying and/or controlling the amount or intensity of irradiation within and/or outside the respective irradiated zone(s).

The present invention is directed to a combined radiator and remote control and switch apparatus and lighting assembly. In one aspect, radiation within the desired irradiation zone is provided while affording illumination or other forms of radiation, with concentration in a smaller focal zone or area or dispersion over a larger zone or area. It is a further aspect to provide a year-round ceiling-mounted, wall-mounted or otherwise mounted or secured combo type radiator and remote control and switch apparatus and lighting assembly, which can provide person(s) sitting near or underneath the radiator and lighting apparatus with illumination and/or infrared irradiation (in numerous possible hybrids, permutations and combinations of concentration and dispersion of various forms of illumination for lighting and/or other forms of radiation, including without limitation, infrared radiation and/or ultraviolet radiation for heating within a selected smaller or larger, as the case may be, focal zone or area) as and when such person(s) desire, coupled with the ease and convenience of remote control and switch apparatus, and without the need for storage of the combo type radiator and lighting apparatus during the periods of warmer climate, nor the need for storage of dangerous fuel as in the case of gas or propane heaters.

As visible light and other forms of radiation are parts of the electromagnetic spectrum, the implementation of the disclosed invention or method to focus, concentrate and direct irradiation from any radiation source to and at any selected zone or object can be simultaneously or conjunctively used with other optical apparatuses, including, but without limitation, fiber optic bundle or apparatus and/or optical lens (including, but without limitation, a prism), mirrors, reflective surfaces or a hybrid, permutation or combination whereof, to achieve the desired goal.

The present invention has an enormously wide scope of applications and users including, without limitation, user friendly automation in remote control and switch apparatus (thus its commercial and industrial value being great) and including, without limitation, focusing, concentrating and directing radiation to or at:

(a) selected area or zone of radiation absorbent surface, object, substance and/or matter on satellite or other astronomic equipment and/or apparatuses in space to achieve an increase in the temperature of such selected area or zone of absorbent surface, object, substance and/or matter relative to its environment or to achieve a temperature differential of said selected area or zone and its environment and providing thrust, torque and propulsion forces in relation to (amongst other things) matters of attitude of satellite or other astronomic equipment and/or apparatuses in space relative to the Sun or other extra-terrestrial body or bodies;
(b) selected radiation absorbent surface, object, substances and/or matter (including, but without limitation, food and other materials) to be manufactured, assembled, installed, erected, constructed, located, repaired, maintained, enjoyed, occupied, consumed, used, or handled (whether indoors or outdoors) by any person, object or thing (including, but without limitation, computerized robotics and cybernetics) in cold weather on Earth, in space or on any other extra-terrestrial or heavenly bodies;
(c) bodies or body tissues (living or dead) or other objects (including, but not limited to objects or subjects of scientific research or medical operations and treatments) and food stuffs in cooking and culinary preparations; and
(d) objects, substances and/or matters (including, but without limitation, food and other materials) that require an increase in its temperature relative to its environment through focused, concentrated or directed or re-directed radiation.

Figure 1A:
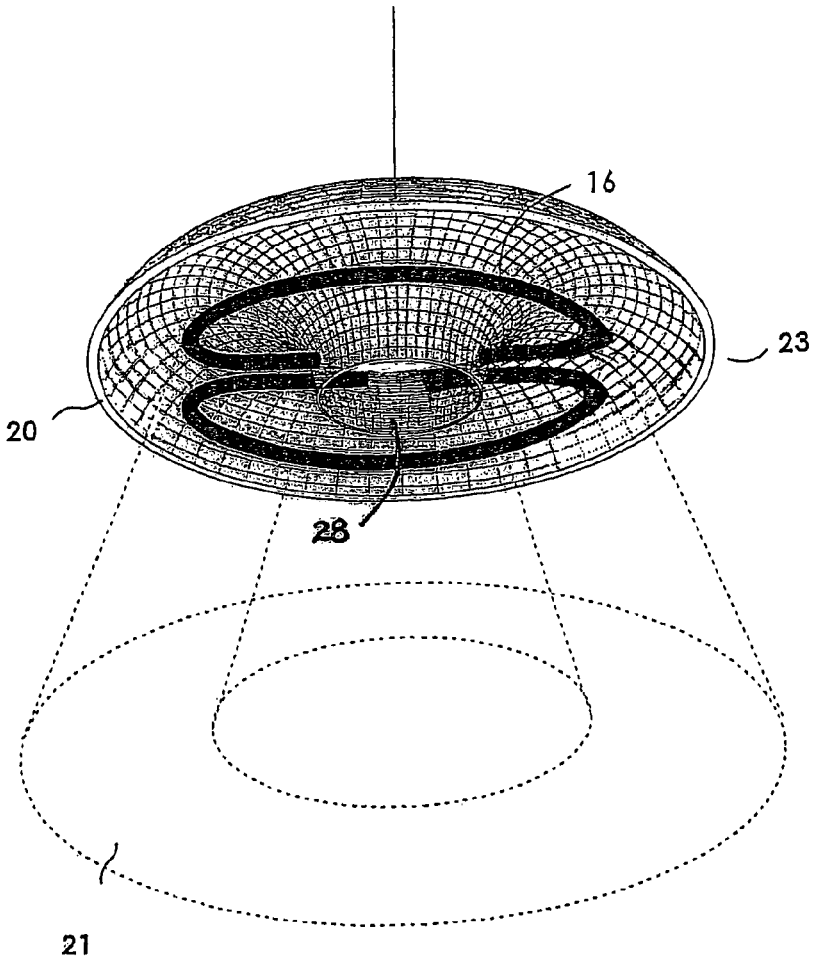
FIG. 1A is a perspective view of a radiator.
Figure 1B:
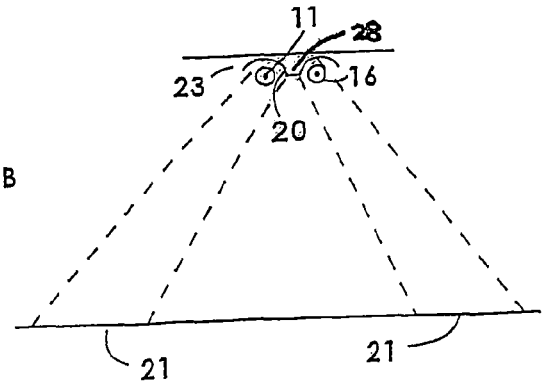
FIGS. 1B and 1C are side cross-sectional views of the radiator of FIG. 1A.
Figure 1C:
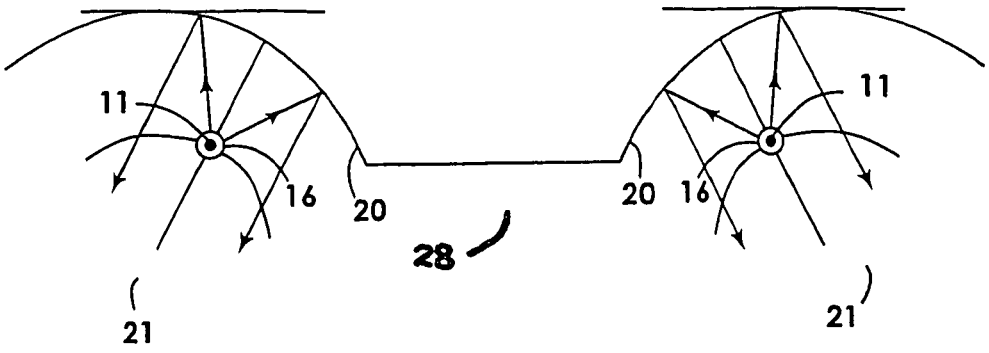
Figure 1D:
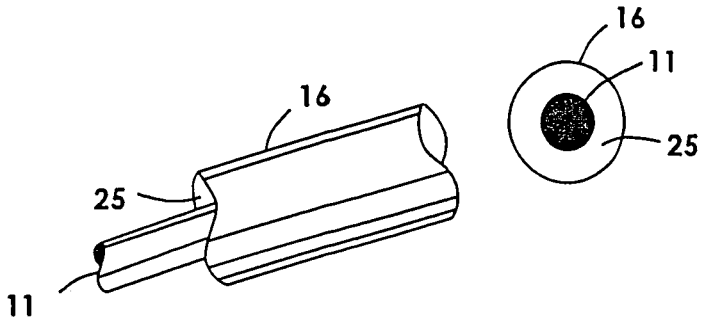
FIG. 1D is perspective view and a side cross-sectional view of a radiation member of the radiator of FIG. 1A.

DETAILED DESCRIPTION (A) One embodiment of such a device is shown in FIG. 1A and FIG. 1B in which a radiation source 10 constructed with electrical coil resistance or other heating elements 11 embedded in and surrounded by electricity insulation and thermal conductive materials 25 (including, but without limitation, magnesium oxide and other metallic oxide, gaseous and liquid substances) in at least two separate semi-circular structures or casings 16 including an at least partial tubular shape as shown in FIG. 1B (comprising one or more materials or matters selected from a group consisting (amongst others) of stainless steel, low carbon steel, aluminum, aluminum alloys, aluminum-iron alloys, chromium, molybdenum, manganese, nickel, niobium, silicon, titanium, zirconium, rare-earth minerals or elements (including, without limitation, cerium, lanthanum, neodymium and yttrium), and ceramics, nickel-iron alloys, nickel-iron-chromium alloys, nickel-chromium alloys, nickel-chromium-aluminum alloys, and other alloys alike and oxides, sesquioxides, carbides and nitrides whereof, or a mixture alloys or oxides, sesquioxides, carbides, hydrates or nitrates whereof, certain carbonaceous materials and other infrared radiating materials) are placed before a generally circular hat-shaped or ring-shaped reflective element 23 constructed of good reflective materials, in the form as shown in FIG. 1C the end(s) of the radiation source 10 being turned towards and passing through aperture(s) on the concave reflective surface 20 and stowed and secured at appropriate location(s) within the recess(es) behind the concave reflective surface 20 (with desirable and appropriate safety features known by those skilled in the art) so that a point on the radiation source 10 facing the generally circular hat-shaped or ring-shaped reflective element 23 is positioned at or near the center point or focal zone of the corresponding segment of the concave reflective surface 20 of the generally circular hat-shaped or ring-shaped reflective element 23 and the infrared radiation emitted from such point on the radiation source is directed or reflected away from the concave reflective surface 20 substantially in the manner as shown in FIG. 1C. The radial cross-section of the structures or casings 16 including an at least partial tubular shape as shown in FIG. 1D may take generally circular, triangular, rectangular, polygonal or elliptical shapes, or hybrids and/or combinations whereof in light of the shape of the generally circular hat-shaped or ring-shaped reflective element with a view to optimizing, maximizing, minimizing or otherwise altering the effect of the irradiation for the selected purposes. The concave reflective surface 20 of the generally circular hat-shaped or ring-shaped reflective element 23 may be conic (being spherical, paraboloidal, ellipsoidal, hyperboloidal) or other surfaces that can be generated from revolution, or in other manner, of quadratic or other equations. The radiation emitted from the generally circular hat-shaped or ring-shaped reflective element 23 is concentrated mainly within the outer irradiated zone 21 as shown in FIG. 1A and FIG. 1B for the purposes of heating or irradiating bodies, objects, substances or matters (including, but without limitation, food and other materials) placed or found within the outer irradiated zone 21, with a view to saving, optimizing, maximizing or otherwise altering the efficient use of energy emitted from the radiation source and whilst reducing or minimizing the effect of radiation on other bodies, objects, substances or matter (including, but without limitation, food and other materials) not within the outer irradiated zone 21 as shown in FIG. 1A and FIG. 1B.

The embodiment is further fitted or engaged with one or more remote control and switch apparatuses 27 whether (a) by way of radio frequency control, microwave control, ultrasonic control, laser control, mechanical control and/or infrared or other form(s) of radiation control or any hybrid, permutation, modification, variation and/or equivalent whereof or whereto, with single channel or single-function, multi-channel or multi-function, or up-gradable or programmable functions, to provide or render maximum convenience and control for remote power activation, variation, modification and control of the radiation source as and when the person(s) sitting near or underneath the radiator so desire, or (b) by way of radiation (including, without limitation, infrared radiation) scanning and detection control systems (whether computer-aided, robotic or cybernetic) for human, animal and/or object (fitting appropriate specifications) presence and/or motion detection so that the radiator will be promptly awaken or activated into action or be in operation only when there are person(s) present in or close to its vicinity, to achieve energy and power saving design and configuration, and offer green and eco-friendly solutions to an environment of comfort.

The remote control and switch apparatus 27 varies, modifies, controls and/or regulates (whether by way of silicon controlled rectifier(s) or other rectifier(s), phase-controlling element(s), potentiometer(s) (including, without limitation, linear, logarithmic, digitally controlled and rheostat), voltage-controlled resistor(s), variable resistor(s), thyristor(s), thyratron(s), trimmer(s), rheostat(s), by-directional triode thyristor(s) or other electricity control device(s) (whether computer-aided, robotic or cybernetic) the electric power supply (including, without limitation, its voltage and/or current) separately to each radiation source of the radiator (including without limitation, at least partially semi-circular tubular radiation source), and the operation and/or the respective temperature and other aspects of each radiation source, and thereby (a) activating, varying, modifying and/or controlling, optimizing, maximizing, minimizing or otherwise altering the electromagnetic radiation emitted from the respective radiation sources of the radiator (including, without limitation, complete or partial constructive interference and/or complete or partial destructive interference whereof), and (b) enhancing, reducing, varying, modifying, controlling and/or regulating the intermittence, exposure, irradiance, amount and/or intensity of the radiation within the inner irradiated zone 22 or the outer irradiated zone 21 (as the case may be).

Figure 4A:
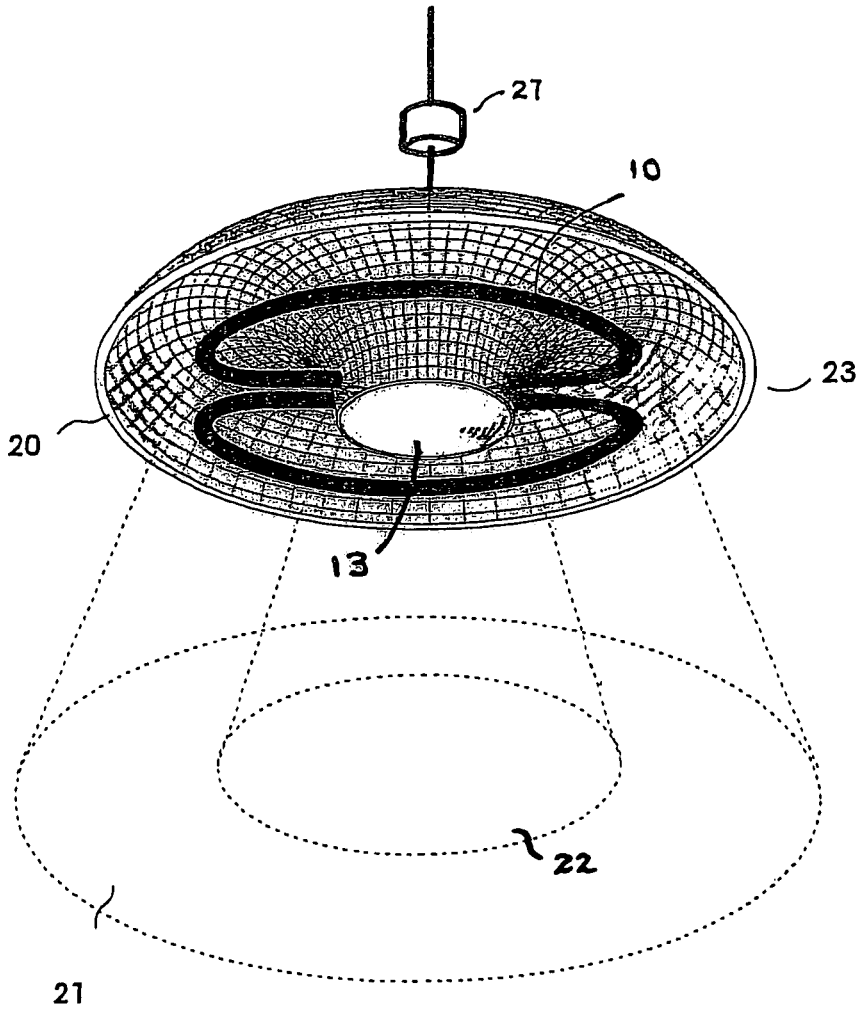
FIG. 4A is a perspective view of a combo type radiator and remote control apparatus with lighting assembly in accordance with the present invention.
Figure 4B:
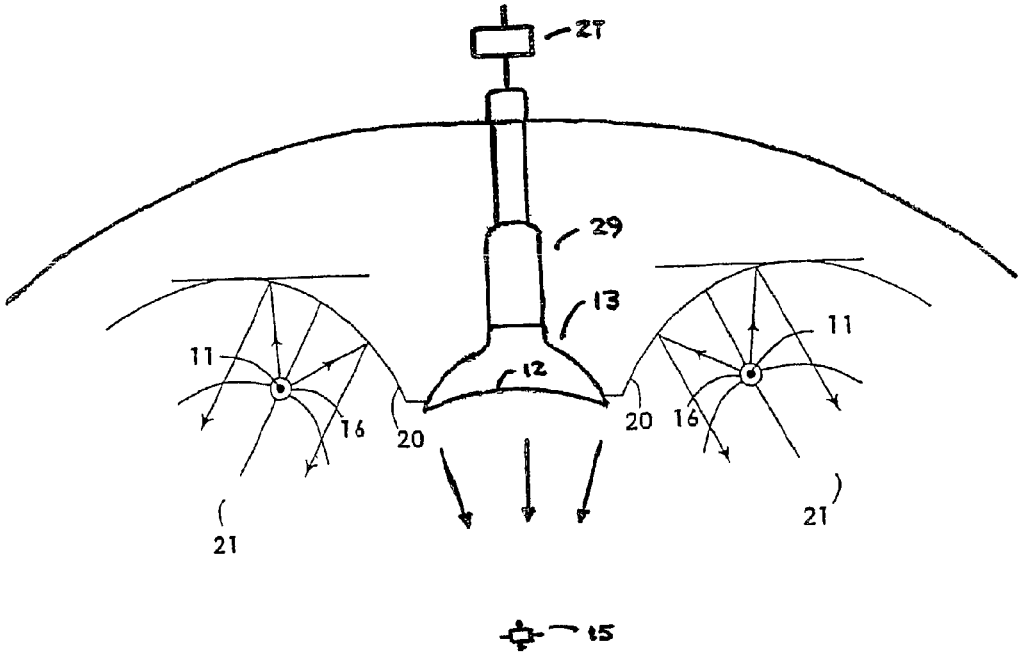
FIGS. 4B and 4C are side cross-sectional views of the combo type radiator and remote control apparatus of FIG. 4A.
Figure 4C:
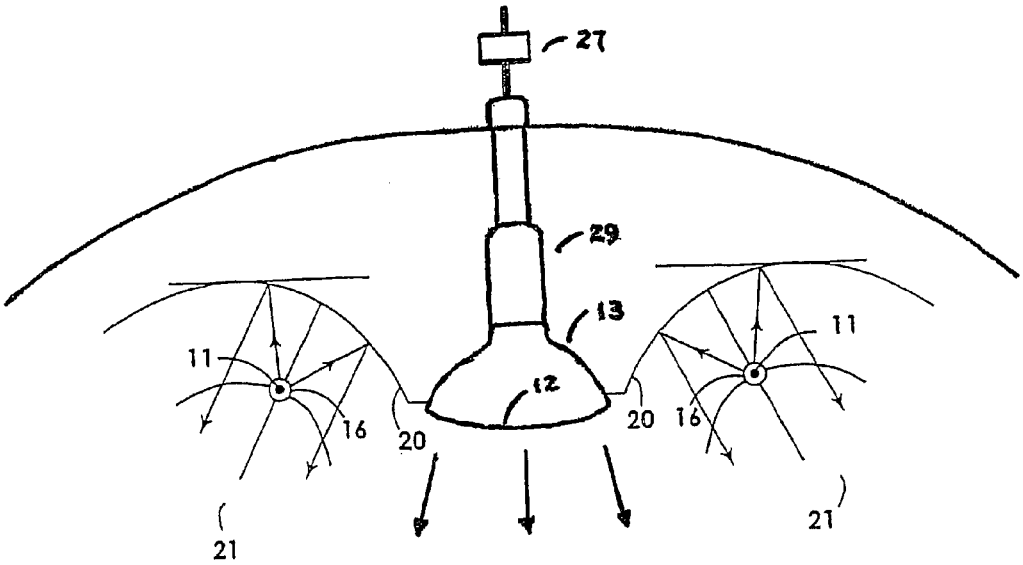
Figure 5A:
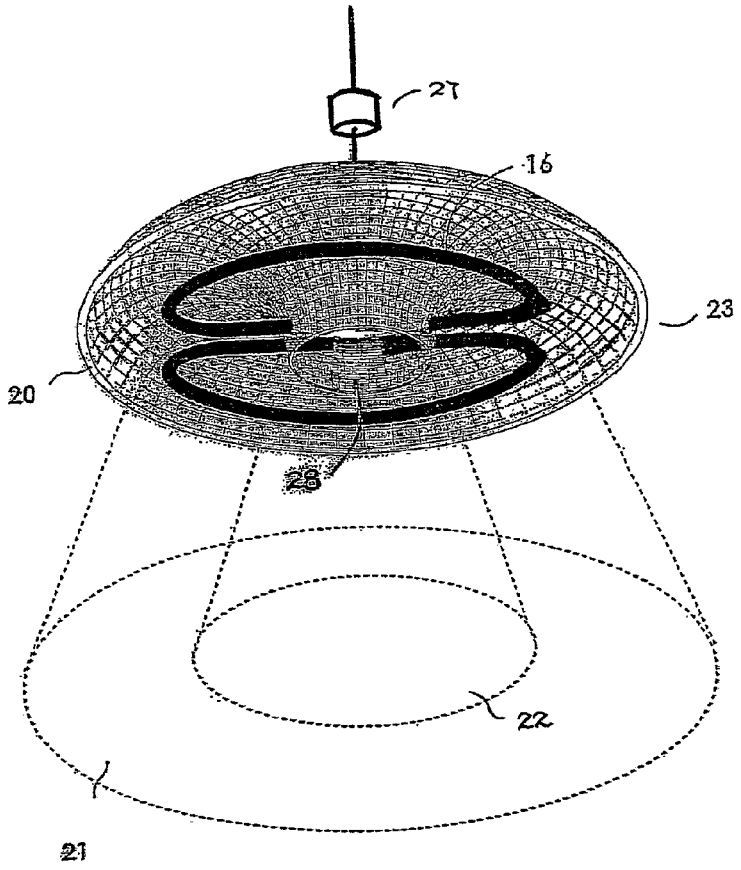
FIG. 5A is a perspective view of a combo type radiator and remote control apparatus in accordance with the present invention.
Figure 5B:
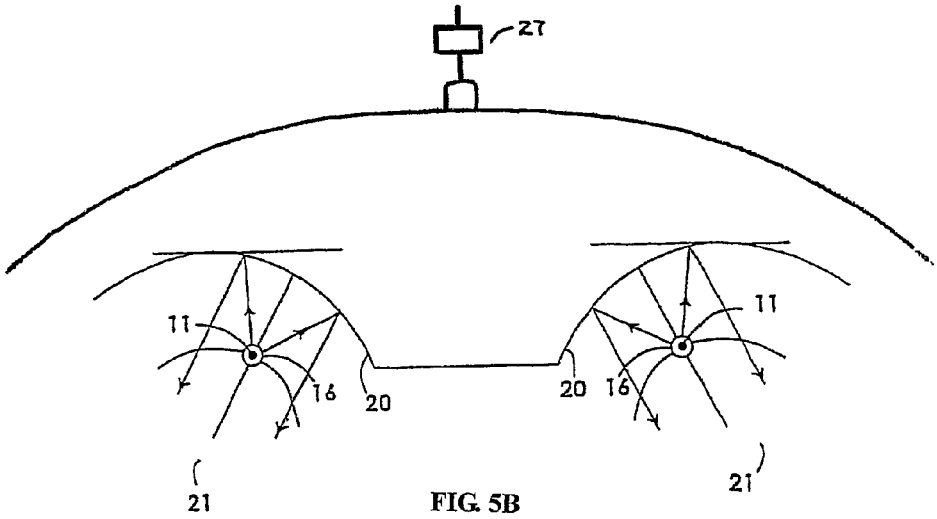
FIG. 5B is a side cross-sectional view of the combo type radiator and remote control apparatus of FIG. 5A.

(B) One embodiment is shown in FIG. 4A comprising two radiation sources with one such radiation source 10 constructed with electrical resistance or other heating elements embedded in and surrounded by electricity insulation and thermal conductive materials (including, but without limitation, gaseous, liquid or solid materials, oxides, sesquioxides, carbides, hydrates or nitrates of silicon materials or magnesium oxides) in two separate at least partially semi-circular tubular structures or casings as shown in FIG. 1A (comprising one or more materials or matters selected from a group consisting (amongst others) of stainless steel, low carbon steel, aluminum, aluminum alloys, aluminum-iron alloys, chromium, molybdenum, manganese, nickel, niobium, silicon, titanium, zirconium, rare-earth minerals or elements (including, without limitation, cerium, lanthanum, neodymium and yttrium), and ceramics, nickel-iron alloys, nickel-iron-chromium alloys, nickel-chromium alloys, nickel-chromium-aluminum alloys, and other alloys alike, and oxides, sesquioxides, carbides and nitrides whereof, or a mixture alloys or oxides, sesquioxides, carbides, hydrates or nitrates whereof, certain carbonaceous materials and other infrared radiating materials) is placed before a generally circular hat-shaped or ring-shaped reflective element 23 constructed of good reflective materials, in the form as shown in FIG. 1C, the end(s) of the radiation source 10 being turned towards and passing through aperture(s) on the concave reflective surface 20 and stowed and secured at appropriate location(s) within the recess(es) behind the concave reflective surface 20 (with desirable and appropriate safety features known by those skilled in the art) so that a point on the radiation source 10 facing the generally circular hat-shaped or ring-shaped reflective element 23 is positioned at or near the center point or focal zone of the corresponding segment of the concave reflective surface 20 of the generally circular hat-shaped or ring-shaped reflective element 23 and the radiation emitted from such point on the radiation source is directed or reflected away from the concave reflective surface 20 substantially in the manner as shown in FIG. 1C. The radial cross-section of the structures or casings 16 including an at least partial tubular shape as shown in FIG. 1D may comprise (without limitation) oxides, sesquioxides, carbides, hydrates or nitrates of silicon materials or magnesium oxides and take generally circular, triangular, rectangular, polygonal or elliptical shapes, or hybrids and/or combinations whereof in light of the shape of the generally circular hat-shaped or ring-shaped reflective element with a view to optimizing, maximizing, minimizing or otherwise altering the effect of the irradiation for the selected purposes. The concave reflective surface 20 of the generally circular hat-shaped or ring-shaped reflective element 23 may be conic (being spherical, paraboloidal, ellipsoidal, hyperboloidal) or other surfaces that can be generated from revolution, or in other manner, of quadratic, cubic or other equations. The radiation emitted from the generally circular hat-shaped or ring-shaped reflective element 23 is concentrated mainly within the outer irradiated zone 21 as shown in FIG. 1A and FIG. 1B for the purposes of heating or irradiating bodies, objects, substances or matters (including, but without limitation, food and other materials) placed or found within the outer irradiated zone 21, with a view to saving, optimizing, maximizing or otherwise altering the efficient use of energy emitted from the radiation source and whilst reducing, minimizing or otherwise altering the effect of radiation on other bodies, objects, substances or matter (including, but without limitation, food and other materials) not within the outer irradiated zone 21 as shown in FIG. 1A and FIG. 1B. The second radiation source 13 may comprise (where appropriate, in conjunction with other radiation source(s) or light source(s)) at least one light source (the radial axes of which may be set perpendicular or at different angle(s) to the perpendicular) coupled with lamp base assembly 60 (including, without limitation, aluminized reflector lamp; parabolic aluminized reflector lamp; standard incandescent lamp; reflector incandescent lamp; tungsten halogen lamp; halogen infrared reflecting lamp; filament lamp; compact fluorescent lamp; linear fluorescent lamp; induction lamp; metal halide lamp; sodium lamp; mercury lamp; high intensity discharge lamp; light emitting diode lamp; ultraviolet lamp; neon lamp; quartz lamp; sensor lamp; down light; electroluminiscent light; flood light; solar light; spot light) which fits into lamp socket assembly 29, located within the hollow section 28 (as shown in FIG. 1A) on, in or forming at least part of the device, designed for receiving such light source(s) with accompanying lamp base assembly 60 as shown in FIG. 4A and FIG. 4C.

The embodiment is further fitted or engaged with one or more remote control and switch apparatus 27 which may be (a) by way of radio frequency control, microwave control, ultrasonic control, laser control, mechanical control and/or infrared or other form(s) of radiation control or any hybrid, permutation, modification, variation and/or equivalent whereof or whereto, with single channel or single-function, multi-channel or multi-function, or up-gradable or programmable functions, to provide or render maximum convenience and control for remote power activation, variation and control of the radiation sources as and when the person(s) sitting near or underneath the radiator so desire, or (b) by way of radiation (including, without limitation, infrared radiation) scanning and detection control systems (whether computer-aided, robotic or cybernetic) for human, animal and/or object (fitting appropriate specifications) presence and/or motion detection so that the radiator will be promptly awaken or activated into action or be in operation only when there are person(s) present in or close to its vicinity, to achieve energy and power saving design and configuration, and offer green and eco-friendly solutions to an environment of comfort.

The remote control and switch apparatus 27 controls and regulates (whether by way of rectifier(s), phase-controlling element(s), bi-directional triode thyristor(s) or other similar devices) the electric power supply (including, without limitation, its voltage and/or current) to each radiation source of the radiator (including without limitation, each semi-circular tubular radiation source separately), and the operation and/or the respective temperature of each radiation source, and thereby (a) activating, varying, modifying and/or controlling, optimizing, maximizing, minimizing or otherwise altering the complete or partial constructive interference and/or the complete or partial destructive interference of the electromagnetic radiation emitted from the respective radiation sources of the radiator, and (b) enhancing or reducing the intensity of the radiation within the inner irradiated zone 22 or the outer irradiated zone 21 (as the case may be).

Figure 2A:
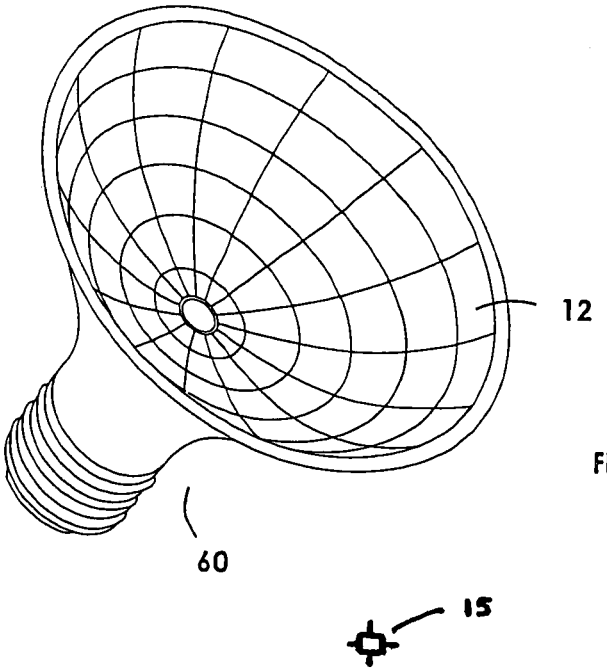
FIG. 2A is a perspective view of a radiator with a lamp base assembly.
Figure 2B:
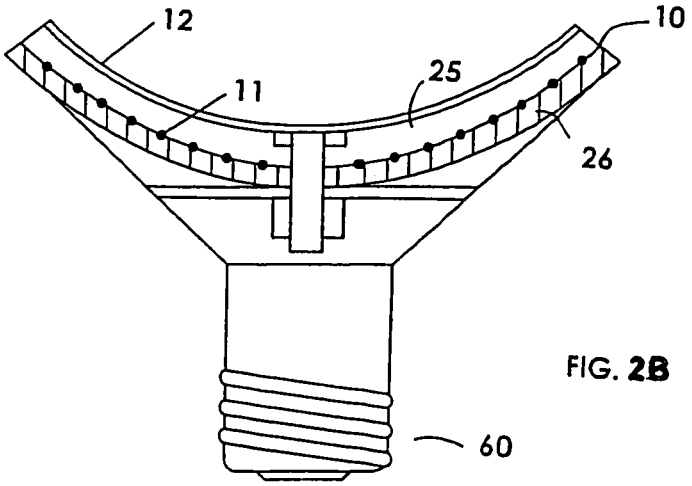
FIG. 2B is a side cross-sectional view of the radiator and the lamp base assembly of FIG. 2A.

(C) In another embodiment as described in Paragraph (B) above, the second radiation source 13 may comprise (where appropriate, in conjunction with other radiation source(s) or light source(s)) at least one device as shown in FIG. 2A, which includes a device coupled with lamp base assembly 60 with a longitudinal axis through the center point or focal zone of the spherical segment 12. The radiation source 10 is constructed with electrical resistance or other heating elements 11 embedded in and surrounded by electricity insulation and thermal conductive materials 25 (including, but without limitation, gaseous or solid materials, oxides, sesquioxides, carbides, hydrates or nitrates of silicon materials or magnesium oxides) on the one side facing the convex surface of spherical segment 12 and thermal insulation materials 26 on the other side. Such embodiment (with desirable and appropriate safety features known by those skilled in the art) will fit into lamp socket assembly 29 designed for receiving such devise with its accompanying lamp base assembly 60. Such a device comprises a radiation source 10 positioned on the convex surface of the spherical segment 12 and lamp base assembly 60, which is accepted by lamp socket assembly 29 in a manner as if it were an electric lamp. Radiation source 10 may comprise of any device or apparatus capable of increasing the surface temperature of the spherical segment 12 to the suitable levels and infrared radiation is focused or concentrated at or towards the center point or focal zone of the spherical segment 12 over a smaller area or zone as shown in FIG. 4A and FIG. 4B.

Figure 3A:
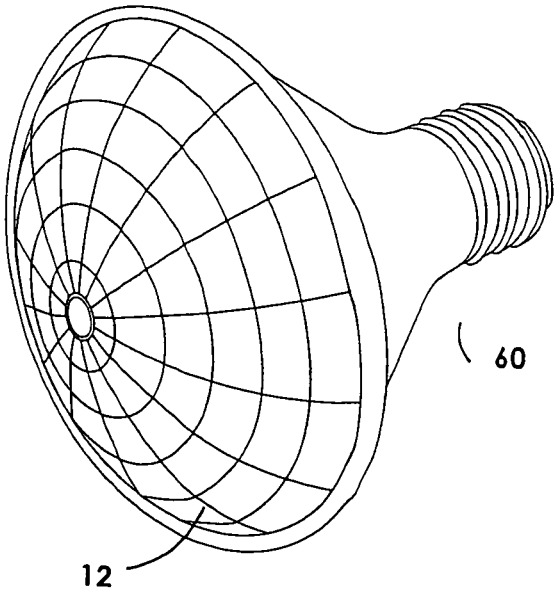
FIG. 3A is a perspective view of a radiator with a lamp base assembly.
Figure 3B:
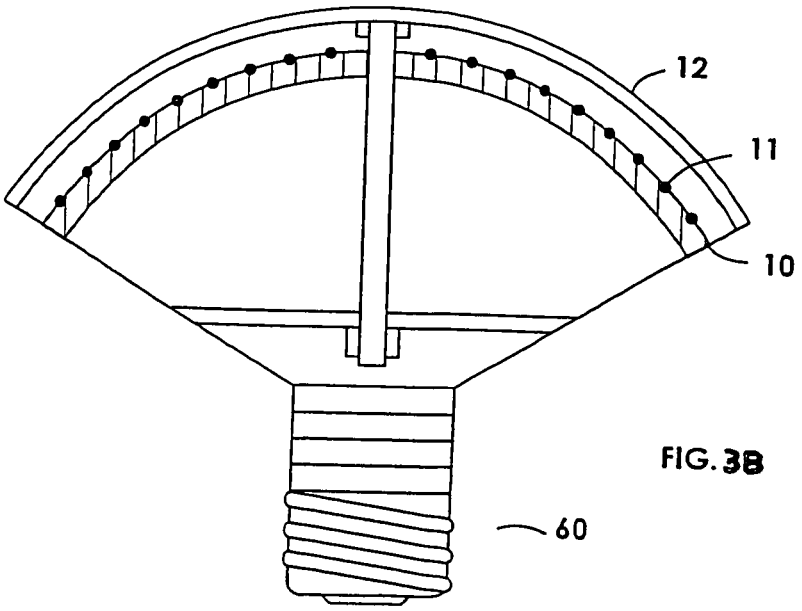
FIG. 3B is a side cross-sectional view of the radiator and the lamp base assembly of FIG. 3A.

(D) In yet another embodiment of such device as described in Paragraph (B) above, the second radiation source 13 may comprise (where appropriate, in conjunction with other radiation source(s) or light source(s)) at least one device as shown in FIG. 3A, which includes a device coupled with lamp base assembly 60 with a longitudinal axis through the center point or focal zone 15 of the spherical segment 12. The radiation source 10 is constructed with electrical resistance or other heating elements 11 embedded in and surrounded by electricity insulation and thermal conductive materials 25 (including, but without limitation, gaseous or solid materials, oxides, sesquioxides, carbides, hydrates or nitrates of silicon materials or magnesium oxides) on the one side facing the concave surface of spherical segment 12 and thermal insulation materials 26 on the other side. Such embodiment (with desirable and appropriate safety features known by those skilled in the art) will fit into lamp socket assembly 29 designed for receiving such devise with its accompanying lamp base assembly 60. Such a device comprises a radiation source 10 positioned on the concave surface of the spherical segment 12 and lamp base assembly 60, which is accepted by lamp socket assembly 29 in a manner as if it were an electric lamp. Radiation source 10 may comprise of any device or apparatus capable of increasing the surface temperature of the spherical segment 12 to the suitable levels and infrared radiation is distributed or dispersed away from the center point or focal zone 15 of the spherical segment 12 over a larger area or zone as shown in FIG. 4A and FIG. 4C.

Those of skill in the art are fully aware that, numerous hybrids, permutations, modifications, variations and/or equivalents (for example, but without limitation, certain aspects of spherical bodies, shapes and/or forms are applicable to or can be implemented on paraboloidal, ellipsoidal and/or hyperboloidal bodies, shapes and/or forms, and certain aspects of control and switch apparatus can be implemented with radio frequency control, microwave control, ultrasonic control, laser control, mechanical control and/or infrared or other form(s) of radiation control or any hybrid, permutation, modification, variation and/or equivalent whereof or whereto, with single channel or single-function, multi-channel or multi-function, or up-gradable or programmable functions, and certain aspects of radiation scanning and detection control systems for human, animal, object and/or motion detection can be implemented with radio-waves, microwaves, infrared waves, ultra-violet waves, x-rays, gamma rays and all other forms of radiation within or outside the electromagnetic spectrum) of the present invention and in the particular embodiments exemplified, are possible and can be made in light of the above invention and disclosure without departing from the spirit thereof or the scope of the claims in this disclosure. It is important that the claims in this disclosure be regarded as inclusive of such hybrids, permutations, modifications, variations and/or equivalents. Those of skill in the art will appreciate that the idea and concept on which this disclosure is founded may be utilized and exploited as a basis or premise for devising and designing other structures, configurations, constructions, applications, systems and methods for implementing or carrying out the gist, essence, objects and/or purposes of the present invention.

In regards to the above embodiments, diagrams and descriptions, those of skill in the art will further appreciate that the optimum dimensional or other relationships for the parts of the present invention and disclosure, which include, but without limitation, variations in sizes, materials, substances, matters, shapes, scopes, forms, functions and manners of operations and inter-actions, assemblies and users, are deemed readily apparent and obvious to one skilled in the art, and all equivalent relationships and/or projections to or of those illustrated in the drawing figures and described in the specifications are intended to be encompassed by, included in, and form part and parcel of the present invention and disclosure. Accordingly, the foregoing is considered as illustrative and demonstrative only of the ideas or principles of the invention and disclosure. Further, since numerous hybrids, permutations, modifications, variations and/or equivalents will readily occur to those skilled in the art, it is not desired to limit the present invention and disclosure to the exact functionality, assembly, construction, configuration and operation shown and described, and accordingly, all suitable hybrids, permutations, modifications, variations and/or equivalents may be resorted to, falling within the scope of the present invention and disclosure.

It is to be understood that infrared radiation within the electromagnetic spectrum in the foregoing for illustrative purposes, without limitation of application of the present invention to radio-waves, microwaves, ultra-violet waves, x-rays, gamma rays and all other forms of radiation within or outside the electromagnetic spectrum except as it may be limited by the claims.

I claim:

1. A combined radiator and remote control and switch apparatus and lighting assembly comprising:

at least one reflection member including an at least partially hat-shaped and/or dome-shaped or other concave reflective surface generated from revolution, or in other manner, of quadratic or other equations and formed with a circular hole extending lengthwise through the reflection member in an axial direction of the reflection member and an inner wall of the circular hole being arranged on a convex side of the reflection member and the concave reflective surface includes an at least partially conical, spherical, paraboloidal, ellipsoidal or hyperboloidal shape; and at least one first radiation member powered by a source of energy and encased in an at least a partial tubular casing, the first radiation member includes an at least partially helical and/or dome-shaped structure defining a center point or a focal zone and having an at least partially circular, triangular, rectangular, polygonal or elliptical base or an at least partially semispherical or quasi-semispherical shape, and being positioned at or near the center point or the focal zone of a corresponding segment of the concave reflective surface of the reflection member, and the radiation so emitted from the first radiation source is directed or reflected away from the concave reflective surface mainly or substantially within an at least partially ring-shaped irradiation zone;

at least an end or terminal of the first radiation member being turned towards and passing through an aperture on the concave reflective surface, and stowed and secured at and appropriate location within a recess behind the concave reflective surface; and the first radiation member is at least partially encased in or positioned inside the reflection member, and the concave reflective surface of the reflection member faces a convex side of the first radiation member, so that the first radiation member concentrates the energy to the center point or the focal zone of the reflection member; and the focal zone of the first radiation member generally coincides with the focal zone of the reflection member; and at least one second radiation member, including:

a thermal conductive layer; and a radiation layer powered by the source of the energy, the radiation layer including at least one radiation element embedded in at least a portion of the thermal conductive layer; and a thermal insulation layer facing the thermal conductive layer; and at least one lamp base assembly coupled to the thermal insulation layer, wherein the lamp base assembly includes positive and negative contactors electrically connected to the radiation layer, and the lamp base assembly is adapted to be received in a lamp socket assembly, and at least one remote control and switch apparatus to activate, vary, modify, regulate, control or optimize at least a particle constructive interference with at least two electromagnetic waves of same frequency are in-phase and the resulting electromagnetic field strength thereto relating much stronger than each of individual ones of the electromagnetic waves, or at least a partial destructive interference with at least two electromagnetic waves of same frequency are out-of-phase and the resulting electromagnetic field strength thereto relating much weaker than each of individual ones of the electromagnetic waves, or combination whereof, of an electromagnetic energy, illumination or radiation, at desired or optimized levels, proportions, amplitudes, intensities, patterns, configurations or embodiments, with identical or matching reference frequencies or wavelengths in corresponding or relative phase, energy or power relationships, simultaneously or intermittently emitted from at least a portion of the first radiation member or at least a portion of the second radiation member, or combination whereof, and concentrated in smaller focal zones of radiation or illumination or dispersed over larger zones of radiation or illumination, for irradiating or illuminating bodies, objects, substances or matters placed or found in the irradiated zones, in desired green and eco-friendly manners for saving energy and power.

2. The combined assembly of claim 1, wherein the first radiation member is positioned at the center point or the focal zone of the reflective surface.

3. The combined assembly of claim 1, wherein the first radiation member includes an electrical resistance covered by or encased in a thermal conductive material.

4. The combined assembly of claim 3, wherein the casing of the electrical resistance includes an at least partial tubular shape.

5. The combined assembly of claim 4, wherein an end or terminal of the at least partial tubular shaped casing of the electrical resistance is turned towards and passing through the aperture on the at least partially ring-shaped concave reflective surface of the reflection member, and the end or terminal are stowed and secured at the location within the recess behind the concave reflective surface.

6. The combined assembly of claim 1, wherein the first radiation member includes an electrical resistance covered by or encased in a metallic material or an oxide, sesquioxide, carbide, hydrate or nitrate of silicon material or the metallic material.

7. The combined assembly of claim 1, wherein the reflection member is generally ring-shaped.

8. The combined assembly of claim 1, wherein the first radiation member is generally ring-shaped.

9. The combined assembly of claim 1, wherein the second radiation member includes at least one light source or radiation source coupled with at least one lamp base assembly, which fits into lamp socket assembly.

10. The combined assembly of claim 1, wherein the radiation layer of the second radiation member is positioned between the thermal insulation layer and the thermal conductive layer.

11. The combined assembly of claim 1, wherein the thermal conductive layer of the second radiation member includes a metallic material or an oxide, sesquioxide, carbide, hydrate or nitrate of silicon material or the metallic material.

12. The combined assembly of claim 1, wherein the thermal conductive layer of the second radiation member includes a solid, gaseous or liquid material.

13. The combined assembly of claim 1, wherein:

the thermal conductive layer of the second radiation member includes a partially spherical shape defining a center point or a focal zone;

the radiation layer of the second radiation member includes a partially spherical shape defining a center point or a focal zone; and the center point or focal point of the thermal conductive layer generally coincides with the center point or the focal zone of the radiation layer.

14. The combined assembly of claim 13, wherein:

the thermal insulation layer includes a partially spherical shape defining a centre point or focal zone;

the center point or the focal zone of the thermal insulation layer generally coincides with the center point or the focal zone of the radiation layer and the center point or the focal zone of the thermal conductive layer.

15. The combined assembly of claim 14, wherein the thermal insulation layer includes a convex side facing a concave side of the thermal conductive layer, so that the radiation element of the radiation layer increases a temperature of the thermal conductive layer and disperses the energy away from the center point or the focal zone of the radiation layer.

16. The combined assembly of claim 13, wherein the thermal insulation layer includes a concave side facing a convex side of the thermal conductive layer, so that the radiation element of the radiation layer increases a temperature of the thermal conductive layer and concentrates the energy to the center point or the focal zone of the radiation layer.

17. The combined assembly of claim 13, wherein the thermal insulation layer includes a convex side facing a concave side of the thermal conductive layer, so that the radiation element of the radiation layer increases a temperature of the thermal conductive layer and disperses the energy away from the center point or the focal zone of the radiation layer.

18. The combined assembly of claim 13, wherein the thermal insulation layer includes a concave side facing a convex side of the thermal conductive layer, so that the radiation element of the radiation layer increases a temperature of the thermal conductive layer and concentrates the energy to the center point or the focal zone of the radiation layer.

19. The combined assembly of claim 1, wherein the remote control and switch apparatus includes a manual, computer-aided, robotic or cybernetic radio frequency control and switch apparatus, microwave control and switch apparatus, ultrasonic control and switch apparatus, laser control and switch apparatus, mechanical control and switch apparatus, radiation control and switch apparatus, or radiation scanning, presence or motion detection control and switch apparatus.

* * * * *